US007032584B2

(12) United States Patent
Tidman et al.

(10) Patent No.: US 7,032,584 B2
(45) Date of Patent: Apr. 25, 2006

(54) SPIRAL MASS LAUNCHER

(75) Inventors: Derek A. Tidman, McLean, VA (US); Mark L. Kregel, Aberdeen, MD (US)

(73) Assignee: Advanced Launch Corporation, McLean, VA (US)

( * ) Notice: Subject to any disclaimer, the term of this patent is extended or adjusted under 35 U.S.C. 154(b) by 0 days.

(21) Appl. No.: 10/838,219

(22) Filed: May 5, 2004

(65) Prior Publication Data

US 2004/0221838 A1 Nov. 11, 2004

Related U.S. Application Data

(60) Provisional application No. 60/467,551, filed on May 5, 2003, provisional application No. 60/273,640, filed on Mar. 7, 2001.

(51) Int. Cl.
*F41B 3/04* (2006.01)

(52) U.S. Cl. ..... 124/6; 124/1; 74/86

(58) Field of Classification Search ..... 74/86, 74/87; 89/8; 124/1, 3, 4, 6, 81
See application file for complete search history.

(56) References Cited

U.S. PATENT DOCUMENTS

| | | | |
|---|---|---|---|
| 2,644,270 | A | 7/1953 | Marong |
| 2,684,062 | A | 7/1954 | Rose |
| 3,185,479 | A | 5/1965 | Ortega |
| 4,238,968 | A | 12/1980 | Cook |
| 4,632,086 | A | 12/1986 | Rutten |
| 4,881,446 | A | 11/1989 | Marks et al. |
| 4,942,775 | A | 7/1990 | Monkewitz et al. |
| 5,388,470 | A | 2/1995 | Marsh, Jr. |
| 5,699,779 | A | 12/1997 | Tidman |
| 5,950,608 | A | 9/1999 | Tidman |
| 6,014,964 | A | 1/2000 | Tidman |
| 6,712,055 | B1 | 3/2004 | Tidman |

OTHER PUBLICATIONS

"Sling Launch of a Mass Using Super-conducting Levitation", (Submitted Oct. 30, 1994), D.A. Tidman, IEEE Trans. Magnetics, vol. 32, No. 1, pp. 240-247, Jan., 1996.

(Continued)

*Primary Examiner*—John A. Ricci
(74) *Attorney, Agent, or Firm*—Arent Fox PLLC

(57) ABSTRACT

A spiral mass launcher for moving a mass including a spindle support assembly; connected to a swing-arm pair module. The spindle support assembly rotates on a motor shaft, allowing the swing-arm pair module to swing on a parallel bearing shaft. A spiral track passes through a radial opening in the bearing shaft. Thus, the swinging motion of the swing-arm pair modules allows the spiral track to move in a gyrating motion. The spiral track has a first end and a second end, the first end adapted to receive a mass or projectile and a second end adapted to launch the mass. A mass can be fed into the spiral mass launcher by either a feed mechanism that feeds the mass into the first end of the spiral. Such feed mechanisms include a feed mechanism that linearly oscillates and picks up the mass at a first amplitude of oscillation and feeds the mass into the first end of the spiral track at a second amplitude of oscillation; or a feed mechanism that includes a continuous tube and "crank arm" feed. The mass can also be fed into the spiral track by a low jitter gun.

11 Claims, 10 Drawing Sheets

OTHER PUBLICATIONS

"Sling Launch of Materials into Space", D.A. Tidman, R.L. Burton, D.S. Jenkins, and F.D. Witherspoon, in Proceedings of the 12th SSI/Princeton Conference on Space Manufacturing, May 4-7, 1995, edited by B. Faughnan, pp. 59-70.
"Slingatron Mass Launchers", D.A. Tidman, Journal of Propulsion and Power, vol. 14, No. 4, pp. 537-544, Jul.-Aug., 1988.
"Slingatron Dynamics and Launch to LEO", D.A. Tidman, Proceedings of the 13th SSI/Princeton Conference on Space Manufacturing, May 8-11, 1997, edited by B. Faughnan, Space Studies Institute, Princeton, NJ, pp. 139-141.
"Slingatron Engineering and Early Experiments", D.A. Tidman and J.R. Greig, Proceedings of the 14th SSI/Princeton Conference on Space Manufacturing, May 6-9, 1999, pp. 306-312, edited by B. Faughnan, Space Studies Institute, Princeton, NJ. (Spiral).
"A Scientific Study on Sliding Friction Related to Slingatrons", D.A. Tidman, UTRON Inc., Final Report for U.S. Army Contract No. DAAD17-00-P-0710, Feb. 20, 2001.
"Optimizing a Slingatron-Based Space Launcher Using Matlab," M. Bundy, G.R. Cooper, S. Wilkerson, and E. Schmidt, Proceedings of the 10th U.S. Army Gun Dynamics Symposium, Apr. 23-26, 2001, Austin, Texas.
"Numerical Simulations of the Slingatron," Proceedings of the 10th U.S. Army Gun Dynamics Symposium, Apr. 23-26, 2001, Austin, Texas.
"The Spiral Slingatron Mass Launcher," CP552, Space Technology and Applications International Forum-2001, edited by M.S. El-Genk, published by the American Institute of Physics, 2001, 1-56396-980-7/01.
"Slingatron: A High Velocity Rapid Fire Sling," published in the Proceedings of the 10th U.S. Army Gun Dynamics Symposium, Apr. 23-26, 2001, Austin, Texas.
"Numerical Simulations of the Slingatron," G.R. Cooper, D.A. Tidman, and M.L. Bundy, AIAA Journal of Propulsion and Power, vol., 18, No. 2, Mar.-Apr., 2002, p. 338-343.
"Sizing a Slingatron-Based Space Launcher," M.L. Bundy, D.A. Tidman, and G.R. Cooper, AIAA Journal of Propulsion and Power, vol. 18, No. 2, Mar.-Apr., 2002, p. 330-337.
"Slingatron: A High Velocity Rapid Fire Sling," D.A. Tidman, AIAA Journal of Propulsion and Power, vol. 18, No. 2, Mar.-Apr. 2002, p. 322-329.
"Study of the Phase-Lock Phenomenon for a Circular Slingatron," G.R. Cooper and D.A. Tidman, AIAA Journal of Propulsion and Power, vol. 18, No. 3, p. 505-508 May-Jun. 2002.
Constant-Frequency Hypervelocity Slings, D.A. Tidman, AIAA J. Propulsion and Power, vol. 19, No. 4., pp. 581-587, Jul.-Aug. 2003.

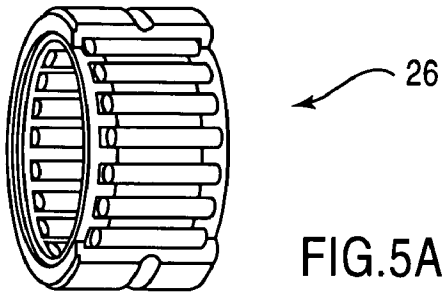
FIG.5A
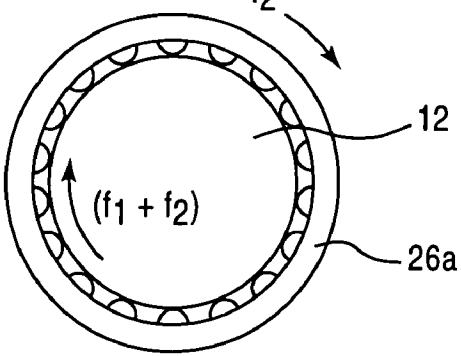
FIG.5B
FIG.5C
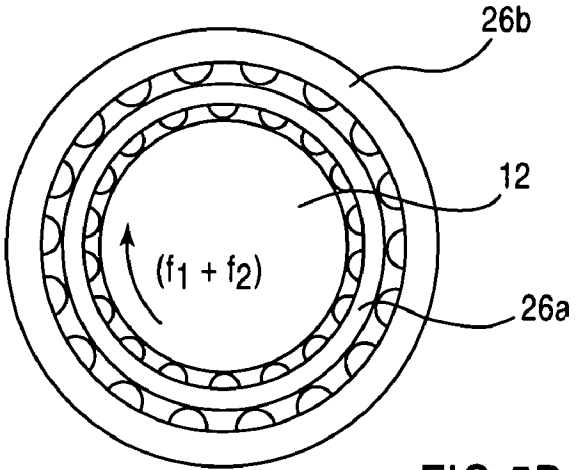
FIG.5D

SPIRAL MASS LAUNCHER

RELATED APPLICATIONS

This application relates to U.S. application Ser. No. 10/091,025 now U.S. Pat. No. 6,712,055, filed on Mar. 6, 2002, which claims priority to U.S. Provisional Patent Application No. 60/273,640, filed on Mar. 7, 2001, which are both incorporated herein by reference in their entirety. This application also claims priority to U.S. Provisional Patent Application No. 60/467,551, filed on May 5, 2003, which is incorporated herein by reference in its entirety.

BACKGROUND OF THE INVENTION

1. Field of the Invention

The present invention relates generally to a device that moves a mass, and more particularly, to an apparatus with a spiral or arcuate track that launches a mass. The present invention may be used to launch objects into space.

2. Description of the Related Art

Mass launchers are generally known. Some examples include U.S. Pat. No. 5,699,779 to Tidman, entitled "Method of and Apparatus for Moving a Mass," U.S. Pat. No. 5,950,608 to Tidman, entitled, "Method of and Apparatus for Moving a Mass," and U.S. Pat. No. 6,014,964 to Tidman, entitled, "Method and Apparatus for Moving a Mass in a Spiral Track," all of which are herein incorporated by reference in their entirety.

While earlier mass launchers were serviceable, they did not permit higher gyration speeds because of structural shortcomings. For example, previous designs would have difficulty achieving higher gyration speeds because they would not be able to safely handle the forces imposed by those higher rotational rates.

Another problem facing previous designs is the aerodynamic or fluid dynamic drag. As the spiral track is gyrated at higher and higher speeds, drag would impose greater and greater loads on many of the components of the spiral mass launcher. Another problem facing spiral mass launchers is the lack of an adequate feed mechanism. One theoretical advantage of spiral mass launchers is their ability to provide a high rate of fire. However, previous designs could not achieve this advantage due to a lack of a suitable feed mechanism that would be able to deliver masses or projectiles into the mass launcher at requisite rates.

In adapting mass launchers to specific applications, those skilled in the art are continually in search of designs that are easy to fabricate and that reduce the loads on the individual components of the mass launchers to therefore increase service life.

SUMMARY OF THE INVENTION

The present invention relates to mass launchers. More specifically, the present invention is directed to a mass launcher having a spiral or arcuate track. The mass launcher of the present invention includes an arm pair module comprised of a spindle support assembly, swing arms, and a launch ring pivot bearing assembly. The spindle support assembly is connected to the launch ring pivot bearing assembly through the swing arms. The swing arm pair module includes an upper arm and a lower arm. The upper arm has a first end and a second end, the first end is pivotally connected to the spindle support assembly, and the second end has a first cup. The lower arm has a first end and a second end, the first end is pivotally connected to the spindle support assembly, and the second end has a second cup. A vertically stacked or radially nested bearing and bearing shaft are disposed within the first and second cups. The bearing shaft includes a radial opening along its longitudinal length so that an arcuate launch tube can pass therethrough. The present invention also includes one or more embodiments as discussed below.

In one embodiment of the present invention, there are a plurality of adjacent arm pair modules. Each of the bearing shafts has a radial opening therethrough so that the launch tube can pass through one bearing shaft to another bearing shaft in the adjacent arm pair module. This configuration eliminates the need for an attachment plate between the tube and a swing arm, and therefore reduces the swinging mass.

In another embodiment of the present invention, the swing arms are flat horizontally arranged arms which allow for easy construction of the mass launcher.

In another embodiment of the present invention, the cups are vertically arranged at the second end of the upper and lower swing arms, to house the bearings around the bearing shaft. For example, in one embodiment, two stacked bearings are provided in each of the upper and lower swing arms. This configuration shares the load carried per bearing at the end of the arm.

In another embodiment of the present invention, concentrically nested bearings allow bearings with a higher rated load to be used while providing a sufficient total speed $f_1+f_2$ since the inner bearing turns inside the outer bearing.

Enabled by the above design embodiments, a relatively larger diameter launch tube is formed to allow the launching of larger mass projectiles. The above embodiments provide bearing assemblies with relatively long life spans and a relatively stiff launch tube span located between adjacent swing arm pair modules.

In another embodiment of the present invention, the mass or projectile is fed into the launch tube using unique projectile-feed approaches such as a low jitter gun, an oscillating feed block, or a centrifugal feed system.

Another embodiment of the present invention includes a phase swing launch method in which a "soft elastic collision" occurs between a projectile traveling in the spiral launch tube and a track displacement wave traveling at high speed around the spiral launch tube. The projectile executes a swing in phase relative to the traveling wave as the projectile accelerates and is thrown forward. The phase swing approach is used to reduce the size of both the ring and spiral mass launcher accelerators.

Another embodiment of the present invention includes a multi-turn spiral launch tube with close turns to approximate a ring that launches a stream of projectiles at a relatively high velocity.

Additional aspects, features, and advantages of the invention will be set forth in the description which follows, and in part will be apparent from the description, or may be learned by practice of the invention. The aspects, features, and advantages of the invention will be realized and attained by the structure and steps particularly pointed out in the written description, the claims, and the drawings.

BRIEF DESCRIPTION OF THE DRAWINGS

FIG. 5A is an isometric diagram of a ring bearing;

FIG. 5B is a schematic diagram of a ring bearing having a stationary ring with a shaft spinning at frequency $f_1$;

FIG. 5C is a schematic diagram of a ring bearing having a ring spinning at frequency $f_2$ and a shaft spinning at frequency $f_1+f_2$;

FIG. 5D is a schematic diagram of an exemplary nested bearing, according to an embodiment of the present invention;

Exhibit 1 is an article titled "Constant-Frequency Hypervelocity Slings," by D. A. Tidman, which describes further aspects and details of the present invention.

Exhibit 2 is a list of publications providing background for the subject matter of the present invention.

DETAILED DESCRIPTION OF THE INVENTION

FIGS. 1–10 illustrate embodiments of the mass launcher of the present invention.

Figure 1:
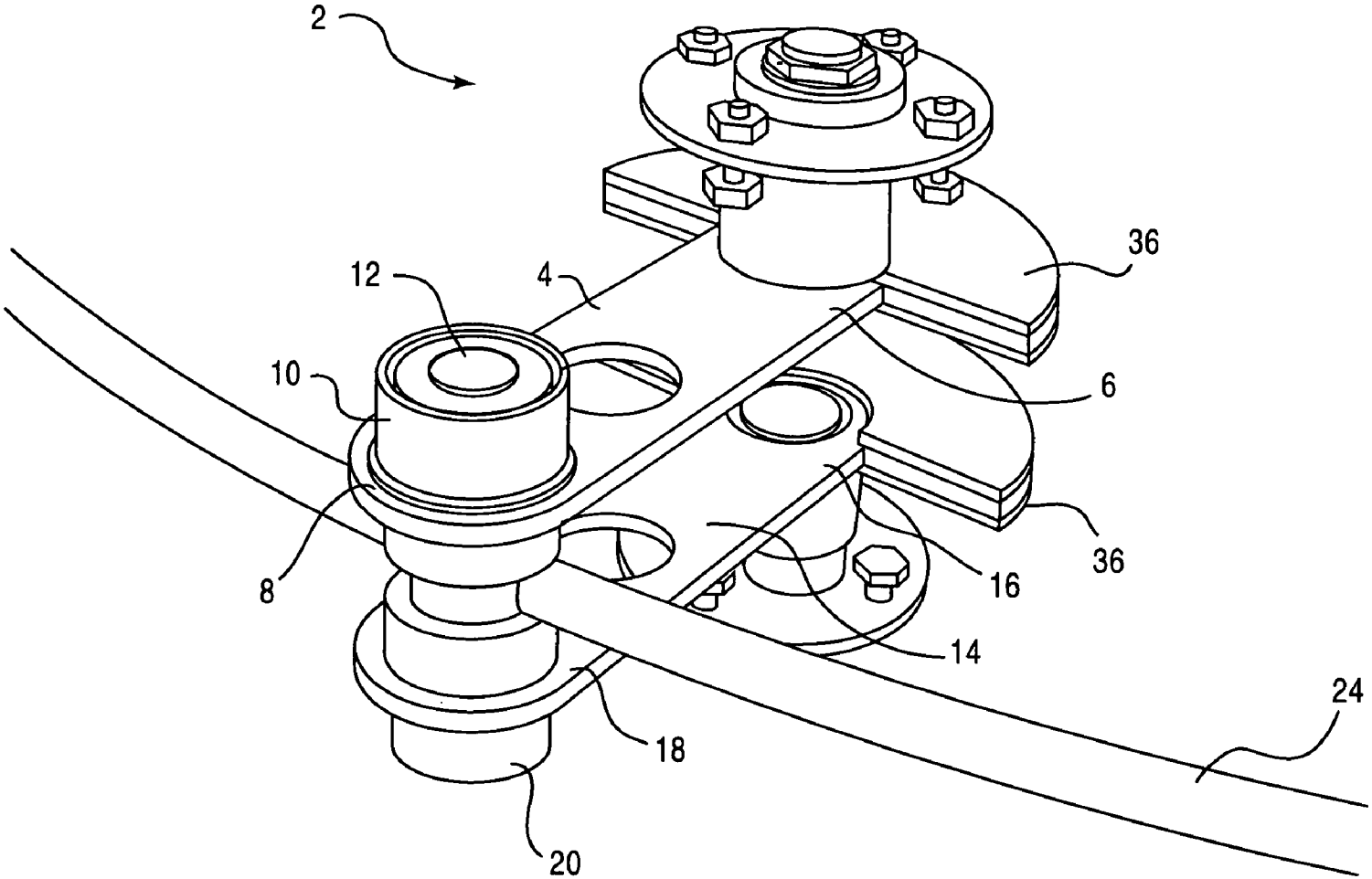
FIG. 1 is an isometric diagram of a portion of an exemplary spiral mass launcher having a launch tube mounted through an opening in a bearing shaft, according to an embodiment of the present invention.

FIG. 1 illustrates a portion of an exemplary spiral mass launcher. A spiral mass launcher of the present invention preferably comprises a track with a hollow or U-shaped channel and includes openings or access points at both ends for a mass or projectile to enter and exit the track. The projectile enters the track at a first end and exits through a second end. As the mass launcher gyrates, relative to the ground, the projectile is subjected to various forces and the motion of the mass launcher tends to move the projectile around the track toward the second end.

The mass launcher of the present invention includes a spindle support assembly 2 including an upper swing arm 4 having a first end 6 and a second end 8, and a lower swing arm 14 having a first end 16 and a second end 18. The first end 6 of the upper swing arm 4 is pivotally connected to the spindle support assembly 2. Counterweights 36 are provided at the second end 8 and 18 of each swing arm 4 and 14. The second end 8 of the upper swing arm 4 includes a first cup 10. The first end 16 of the lower swing arm 14 is pivotally connected to the spindle support assembly 2. The second end 18 of the lower swing arm 14 has a second cup 20. A bearing shaft 12 is disposed within the first cup 10 and the second cup 20.

The bearing shaft 12 is connected to the upper 4 and lower 14 swing arms, which are swingably fixed to the spindle support assembly 2. In one embodiment, two needle bearing 26 are stacked in each swing arm 4 and 14, respectively, providing four needle bearings in each arm-pair module, which is also referred to as a launch ring pivot bearing assembly. See FIG. 2.

Figure 2:
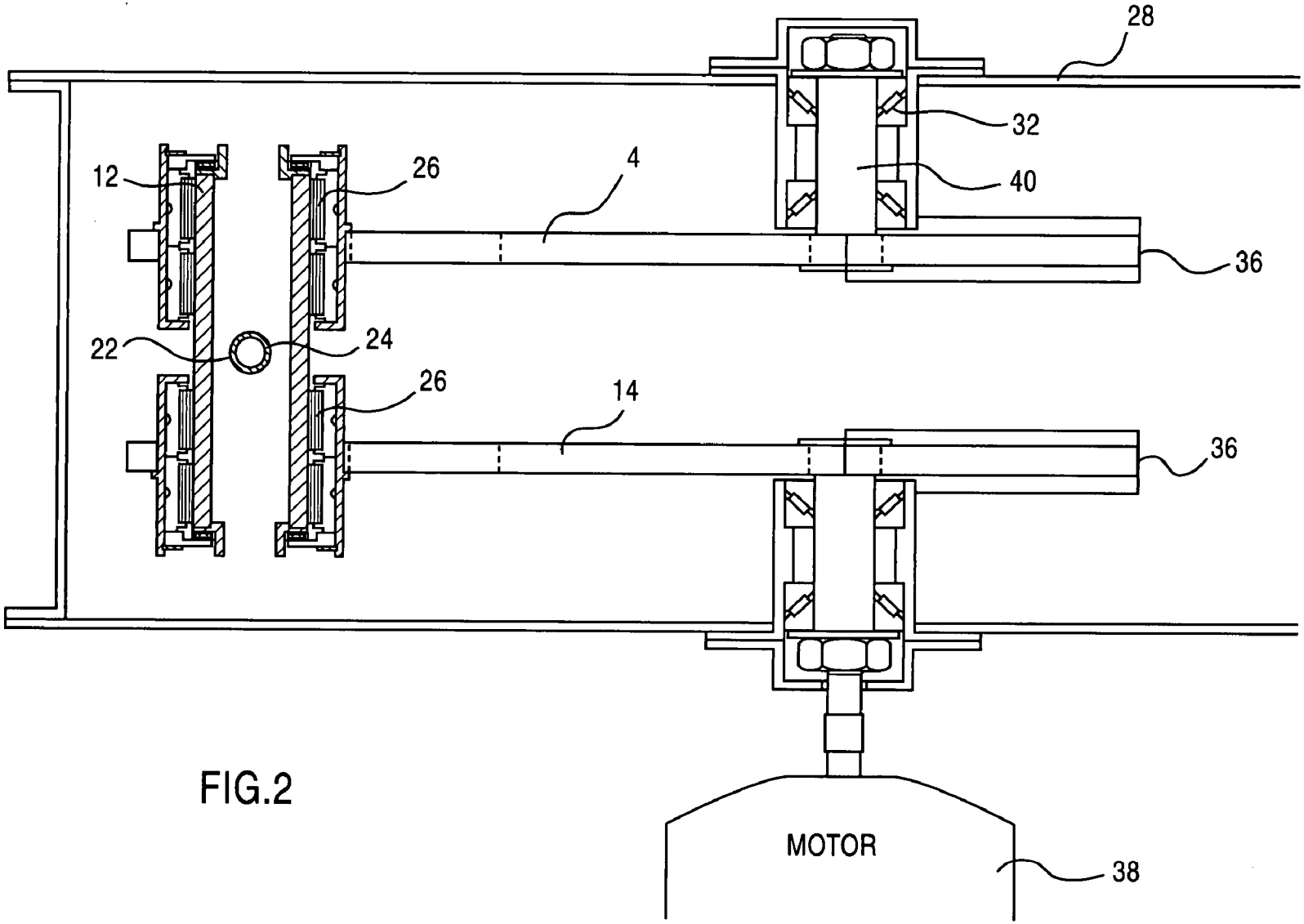
FIG. 2 is a schematic diagram of a cross-sectional side view of an exemplary swing-arm pair module showing a launch tube passing through a bearing shaft, according to an embodiment of the present invention.
Figure 3B:
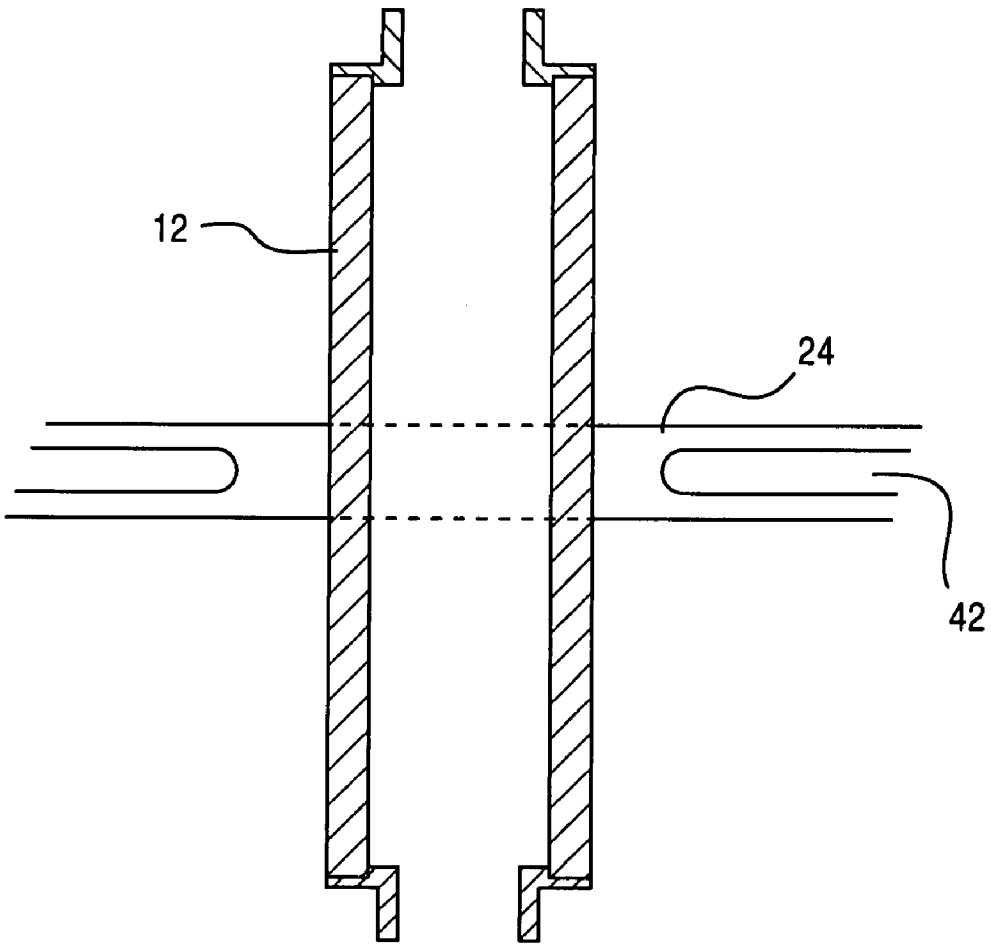
FIGS. 3A and 3B are schematic diagrams of cross-sectional side views of a launch tube passing through an exemplary bearing shaft, according to an embodiment of the present invention.
Figure 3A:
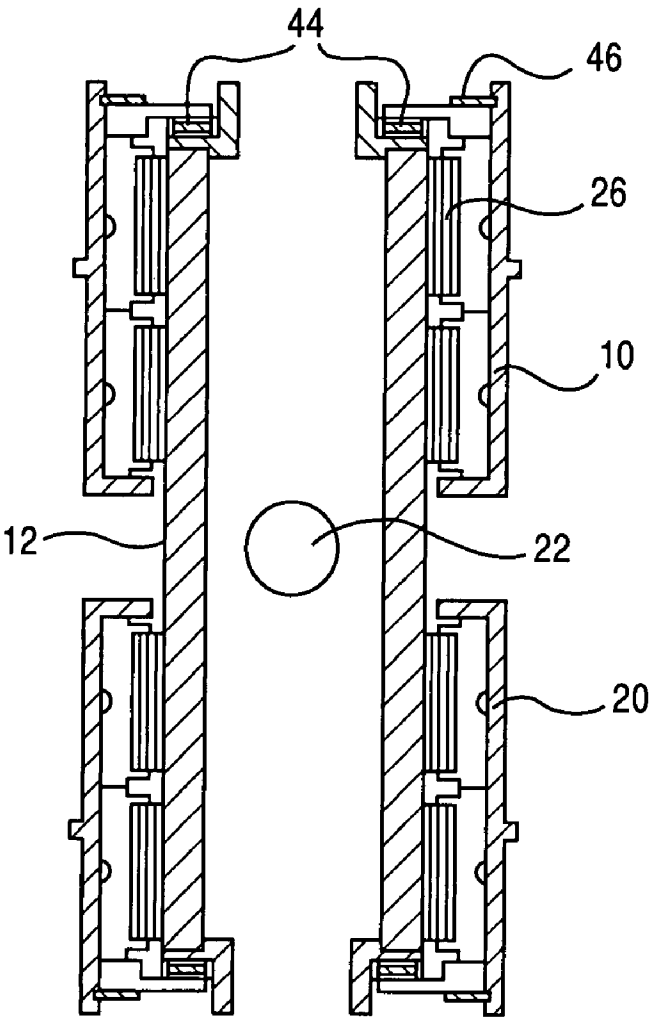

The bearing shaft 12 is illustrated in FIGS. 2 and 3A as having a radial opening 22 in which a launch tube 24 is disposed.

Figure 6:
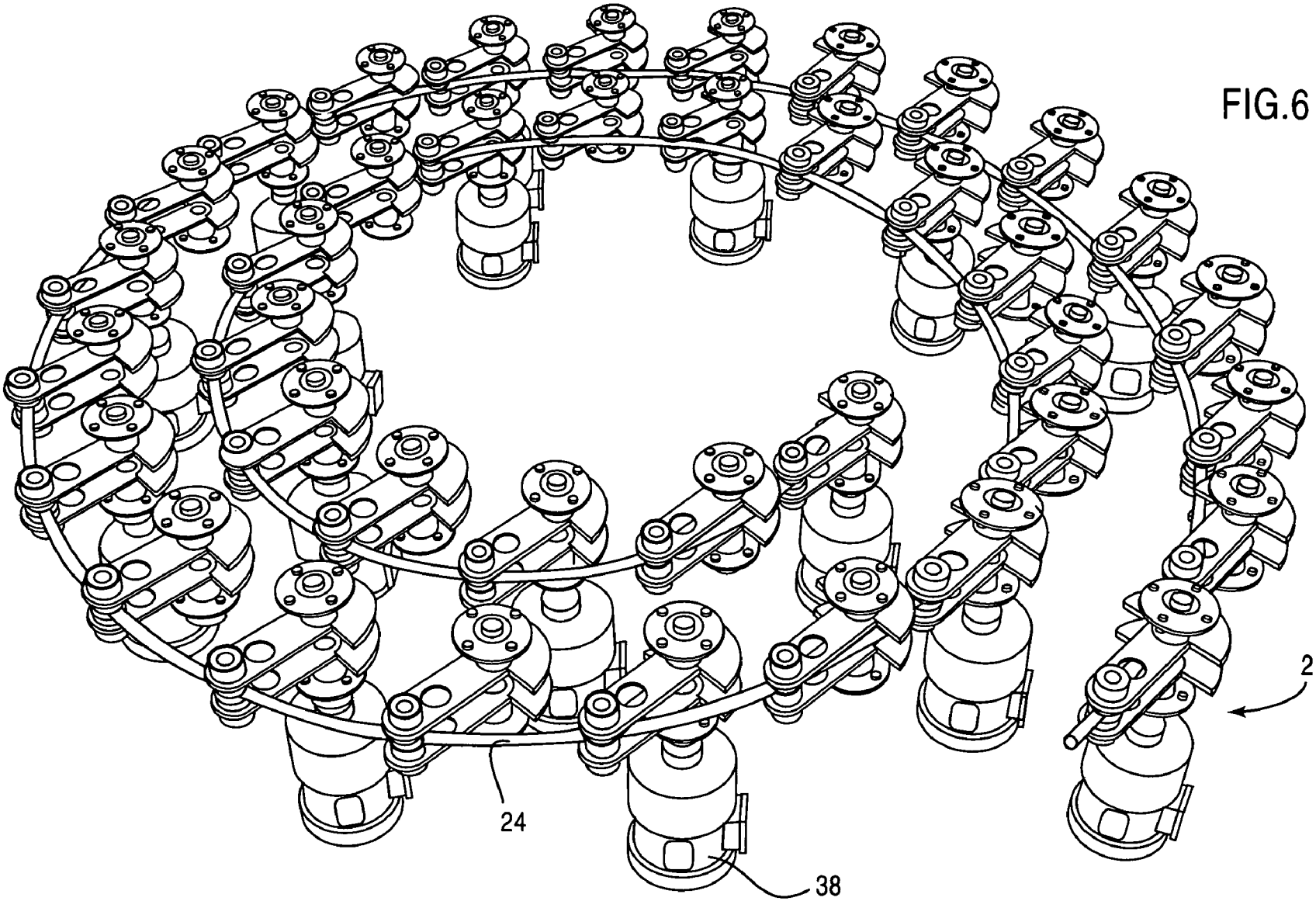
FIG. 6 is a schematic diagram of an exemplary two-turn system, according to an embodiment of the present invention.

In one embodiment of the present invention, the launch tube 24 forms a spiral track as shown in FIG. 6 for example.

FIG. 2 shows a cross-sectional side view of an exemplary swing-arm pair module showing the launch tube 24 passing through a bearing shaft 12, according to an embodiment of the present invention. This cross-sectional view shows two needle bearings 26 stacked in each swing arm 4, 14. FIG. 3A shows the bearing shaft 12 disposed inside of the needle bearing 26. The spindle support assembly 2 also includes a plurality of tapered roller bearings 32 disposed on the outer surface of a motor shaft 40. The motor shaft 40 is operatively connected to a motor 38, which turns the shaft 40 for rotating the spindle support assembly 2.

FIG. 2 illustrates an exemplary swing arm module and launch track enclosed in a housing 28 to reduce drag on the individual components of the swing-arm pair module.

FIGS. 3A and 3B show cross-sectional side views of a launch tube 24 passing through the opening 22 of the exemplary bearing shaft 12, according to an embodiment of the present invention. The launch tube 24 also has a plurality of venting slots 42 extending along the length of the tube. The venting slots 42 permit the escape of air, thus reducing air drag and resistance on the projectile. Preferably, the slots 42 are formed on the inner curve of the track. In other words, slots 42 are disposed in a region away from the path of contact between the projectile and the track. The launch tube 24 is formed from a material having a low friction coefficient, such as, for example, steel.

The needle bearings 26 in the cups 10, 20 rotate along the outer surface of the bearing shaft 12, between the bearing shaft 12 and the inner surfaces of the first and second cups, 10, 20, respectively. Thrust bearings 44 are disposed on a shoulder portion of the bearing shaft 12 to retain the bearing shaft 12 in a stable position with respect to the cups 10, 20, and also reduce friction between the shoulder portion of the bearing shaft 12 and the washer 46. The bearing shaft 12 is also formed from a material having a low friction coefficient, such as, for example, steel.

Figure 4A:
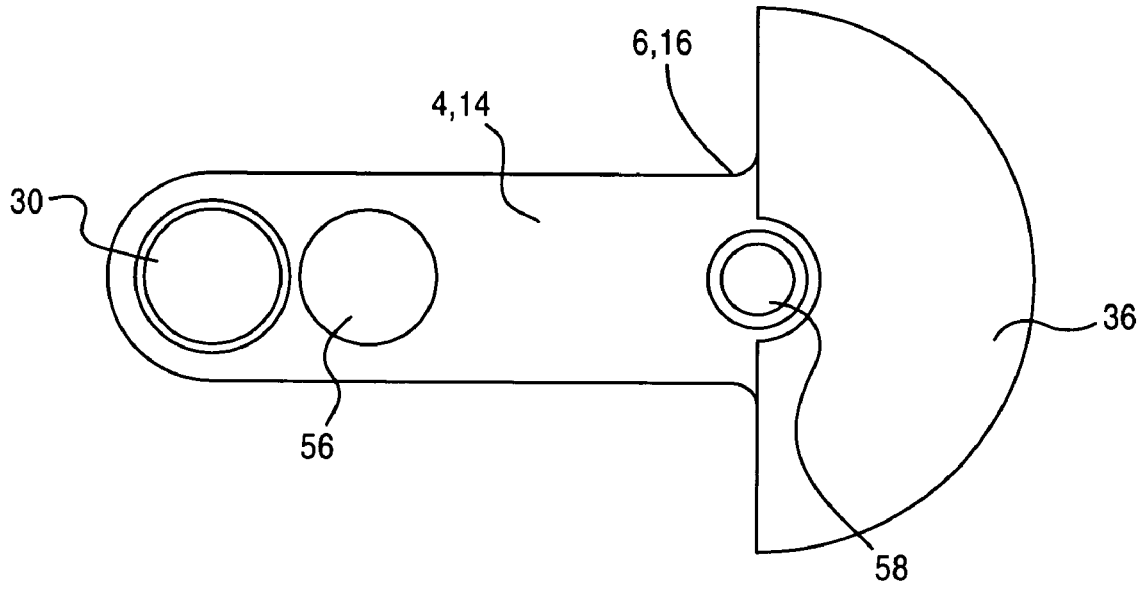
FIG. 4A is a schematic diagram of a top view of an exemplary swing-arm, according to an embodiment of the present invention.
Figure 4B:
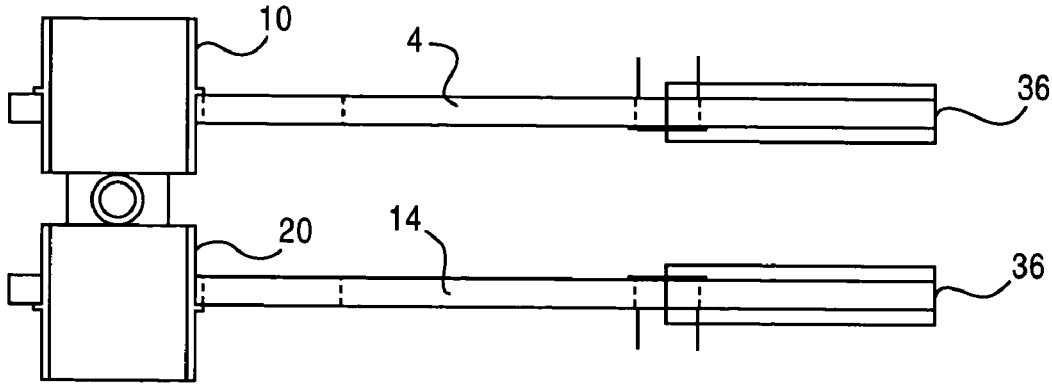
FIG. 4B is a schematic diagram of a side view of an exemplary swing-arm pair module, according to an embodiment of the present invention.

FIG. 4A illustrates a top view of an exemplary swing-arm, according to an embodiment of the present invention. FIG. 4B shows a side view of an exemplary swing-arm pair module, according to an embodiment of the present invention. Each swing arm 4, 14 is flat and disposed horizontally relative to the ground to allow for easy construction of the launcher. The first end 6, 16 of swing arm 4, 14 includes an aperture 58 to receive the motor shaft 40. The second end 8, 18 of the swing arm 4, 14 includes an aperture 30 for inserting the bearing shaft 12. The swing arm 4, 14 also includes a center aperture 56 to reduce the weight of the arm. The swing arms 4, 14 and spindle support assembly 2 can be made from steel, or a lighter weight material such as titanium alloy.

FIG. 5A illustrates a ring of needle bearings, or ring bearing 26. FIG. 5B shows the ring bearing having a stationary ring 26*a* with a bearing shaft 12 disposed therein. The bearing shaft 12 spins at frequency $f_1$. FIG. 5C shows a ring bearing having a ring 26*a* spinning at frequency $f_2$ and a bearing shaft 12 disposed in the ring 26*a* spinning at frequency $f_1+f_2$. FIG. 5D illustrates an exemplary nested bearing, according to an embodiment of the present invention. In the nested bearing of FIG. 5D, the ring 26*b* of the outer bearing is stationary and the outer bearing encloses the inner spinning bearing. The radial nesting of the bearings for large rated loads and high gyrations allow the swing arm module to have a larger diameter shaft resulting in less flexure for load sharing.

The present invention contemplates at least two ways to increase the load capacity of bearings at the end of a swing arm of given swing radius r. One method is to vertically stack bearings 26 in the upper 4 and lower 14 arms as shown, for example, in FIGS. 2 and 3A. A second method of increasing the bearing load capacity is to radially or concentrically nest two bearings as shown in FIG. 5D. In a further embodiment, both of these methods are used.

Typically, as the radius of the bearing ($r_{brg}$) shown in FIG. 5B, and axial length of a bearing of fixed design shown in FIG. 5A, increases, the rated load of the bearing increases as $r_{brg}^2$, and the maximum speed of the bearing in revolutions per minute decreases at a rate equal to the inverse of the bearing radius, or $1/r_{brg}$. If a sufficiently large bearing 26*a* is chosen to satisfy a desired rated load $L_1$, but has a maximum speed of $f_1$ that is too small, then the bearing 26*a* should be enclosed in an even larger bearing 26*b* so that the outer race of bearing 26*a* spins inside bearing 26*b* with a maximum speed of $f_2$. See FIGS. 5B–5D. This provides the desired shaft speed $f_1+f_2$ without reducing the desired rated load $L_1$. However, the rated load $L_2$ of the larger outer bearing 26*b* must then suffice for both the original shaft load plus the additional load due to the mass of the inner bearing, i.e., in this case:

$$L_2 > L_1 + m_1\left(\frac{v^2}{r}\right),$$

where $m_1$, is the mass of the inner bearing.

Those skilled in the art of bearing design would appreciate how to optimize the gain from this combination.

Thus, the present invention provides multiple ways by which to increase the rated load for high speed, namely by vertical stacking, by radial nesting, or by a combination thereof.

As shown in FIG. 5D, the center ring 26*a* (between the bearing shaft 12 and the outermost ring 26*b*) is located (floats) between two rings of rollers. If the bearing shaft 12 is powered up to speed, and the outermost ring is anchored to be stationary, rolling friction between the bearing shaft 12 and outer ring 26*b* will spin the center ring. The rollers adjacent to the shaft accelerate the center ring, and the rollers in the outer bearing 26*b* will decelerate the center ring. The center ring is rapidly brought up to a speed for which these two rolling friction forces come into equilibrium, which occurs very rapidly when the load forces are large. Analysis shows that the center ring reaches a speed between the surface speed of the shaft and zero, and this equilibrium speed is a function of roller radii (assuming all rollers and races have the same surface quality).

FIG. 6 illustrates an exemplary two-turn system, according to an embodiment of the present invention. In this embodiment, a plurality of electric motors 38 is distributed around the system, such that one electric motor 38 provides power to more than one swing arm module. For example, it is envisioned that a single motor 38 provide power to three or four swing-arm pair modules. As such, the cost of manufacturing the spiral mass launcher can be reduced. The number of motors per swing-arm pair module depends upon how much power is needed to swing the arms. Few relatively large motors are able to provide the same power as smaller motors for each swing-arm pair module because with the larger motors, the swing-arm pair modules are locked together due to the rigidity of the tube. Therefore, the arms swing at the same rate.

Figure 7:
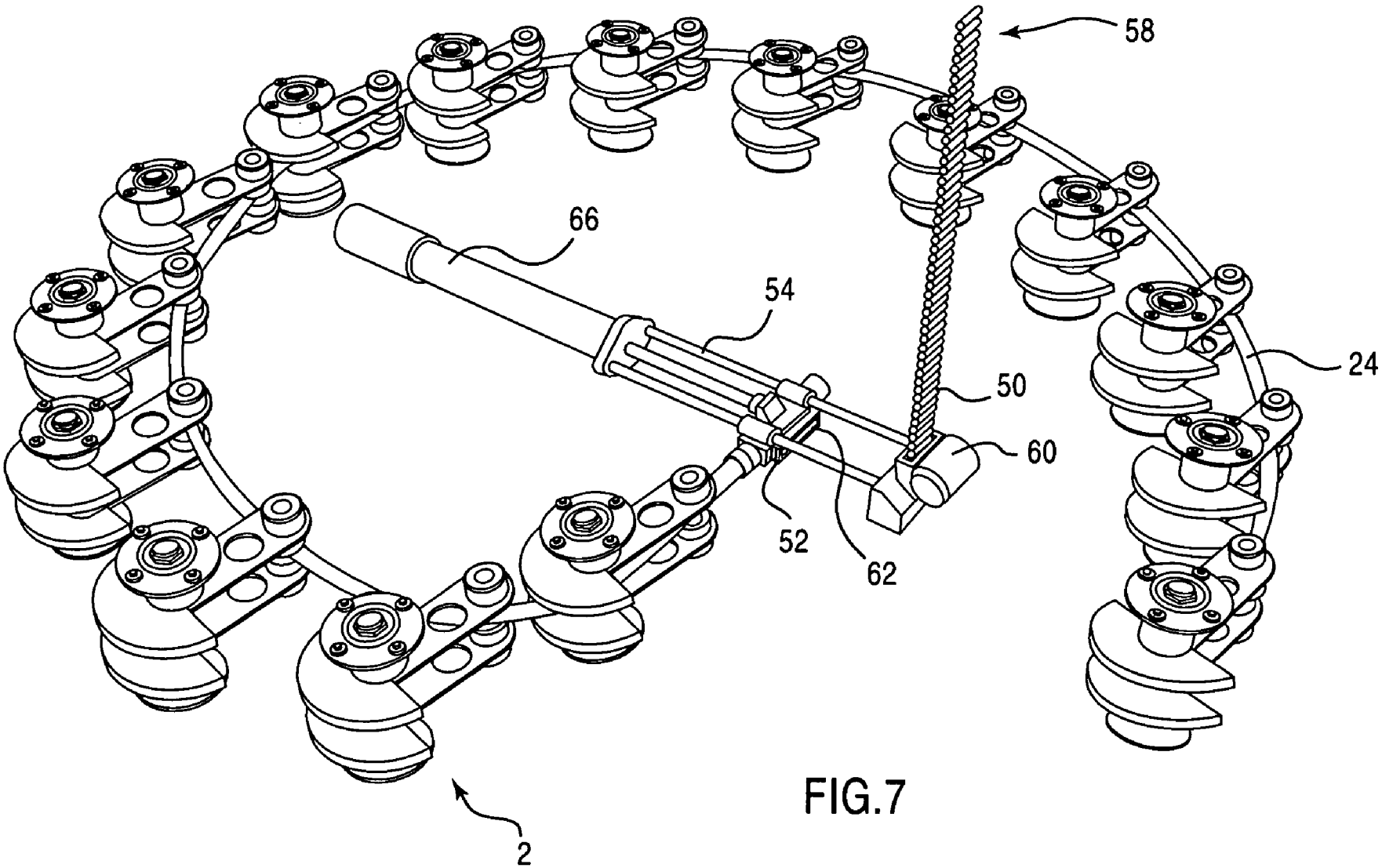
FIG. 7 is a schematic diagram of an exemplary linearly oscillating projectile feed block, according to an embodiment of the present invention.

There are several ways to feed a series of projectiles into an gyrating spiral tube. For example, FIG. 7 illustrates an exemplary linearly oscillating projectile feed block, according to an embodiment of the present invention. FIGS. 8A–8F illustrate an exemplary operation of the feed block of FIG. 7, according to an embodiment of the present invention. As shown in these progressive schematics, the projectiles 50 are injected from a feed block 52 that linearly oscillates on rails 54 and matches speed and position with the feed block entrance 62 at the mid-point of the rails 54. See FIGS. 8A and 8B. The feed block 52 briefly comes to rest at a maximum amplitude on the right side of the rails 54, as illustrated in FIG. 8C, where the feed block 52 picks up a projectile 50 from the projectile feeder 60, through which the projectiles 50 are fed to the feed block 52. The projectile 50 is fed into the projectile entrance 62 of the feed block 52. As illustrated in FIG. 7, for example, the projectiles are arranged as a belt and individually fed into the projectile feeder 60.

Figure 8A:
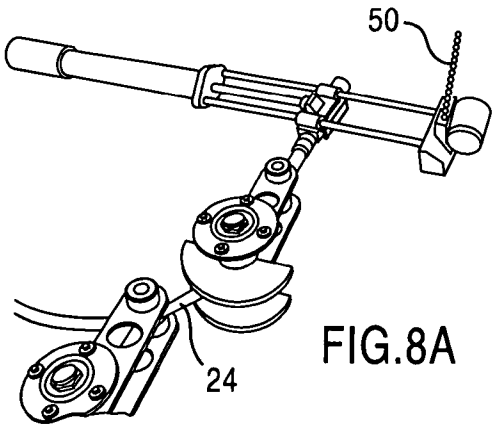
FIGS. 8A–8F are isometric diagrams illustrating an exemplary operation of the feed block of FIG. 7, according to an embodiment of the present invention.
Figure 8B:
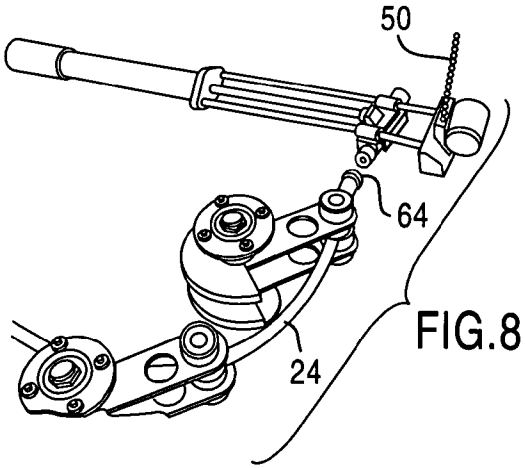
Figure 8C:
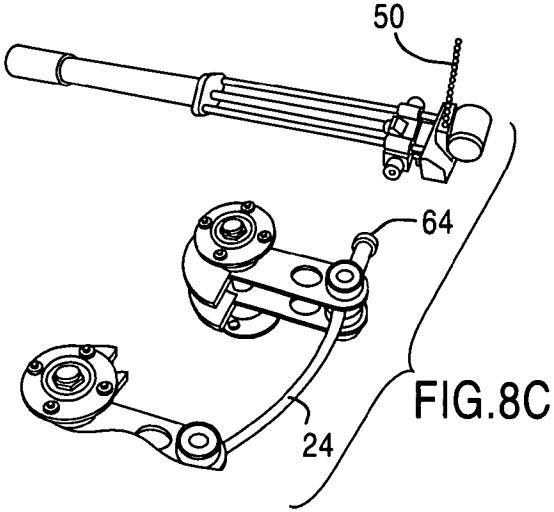

As shown in FIG. 8A, the projectiles 50 are transferred from the feed block 52 to the launch tube 24 when the feed block 52 contacts the launch tube during the feed block travel to the right at the midpoint of the rails 54.

Figure 8D:
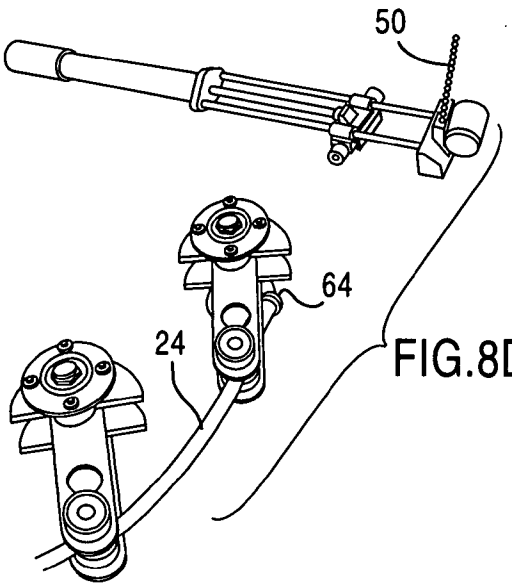
Figure 8E:
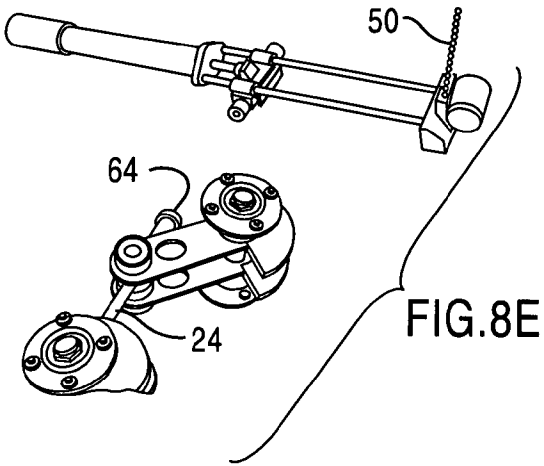
Figure 8F:
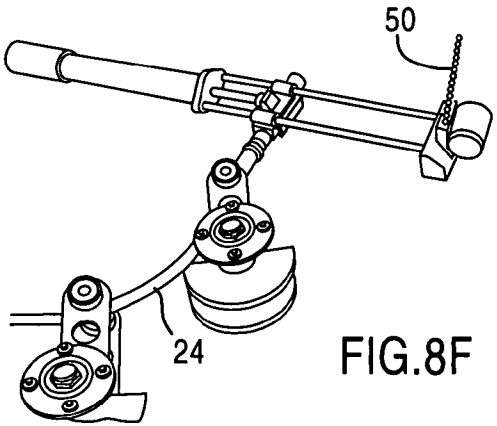

Once the projectile 50 is fed into the feed block 52, as illustrated in FIG. 8C, the center piston 66 then carries the injection block with a projectile 50 back along the rails 54, as illustrated in FIG. 8D, after which, as illustrated in FIG. 8E, the feed block 52 returns to the left and then returns to the right, and passes through a center position very close to the launch tube entrance 64 with the same velocity as the entrance. The projectile 50 is then injected into the launch tube 24 during the close pass. See FIG. 8F.

Figure 9:
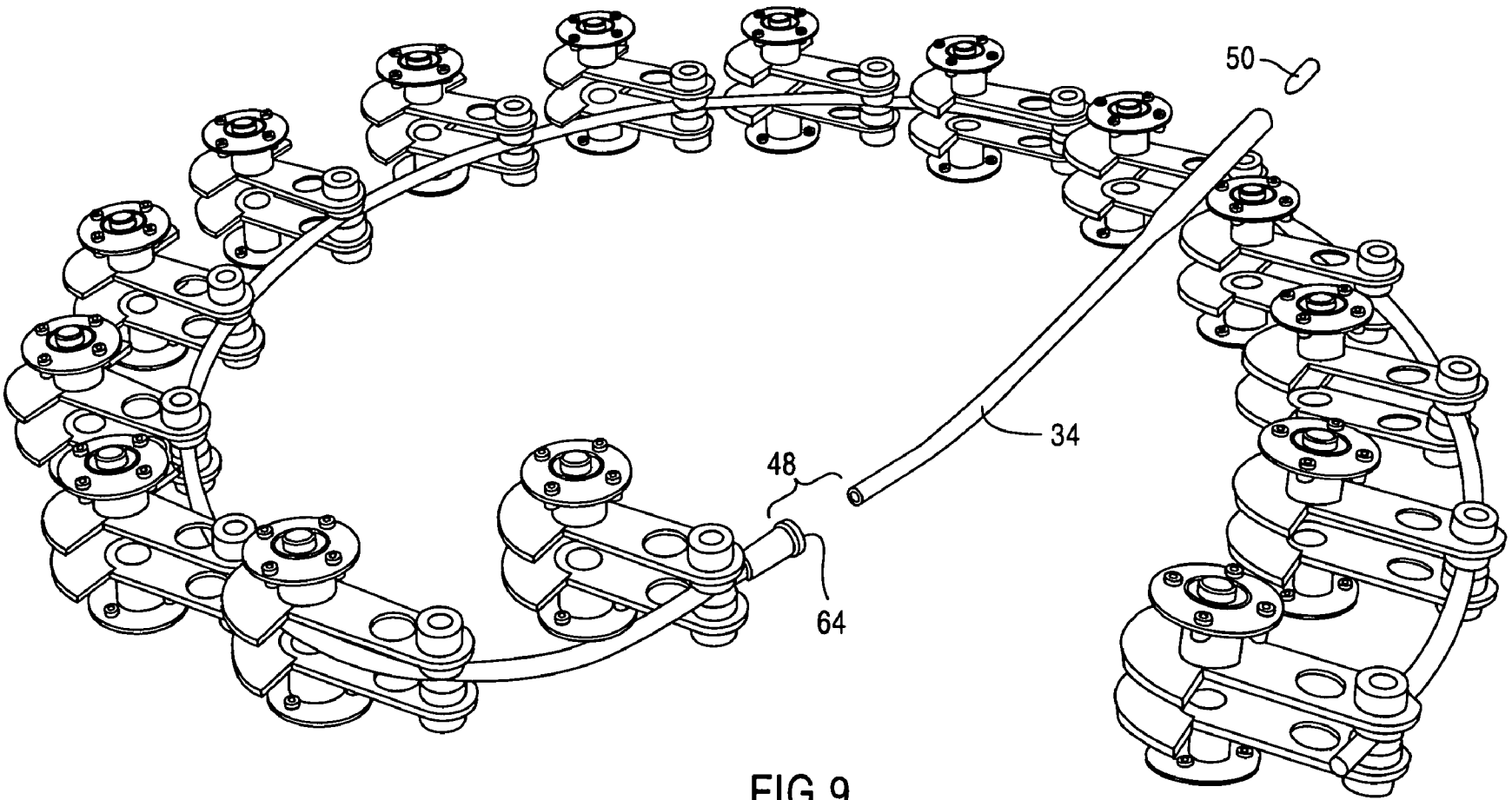
FIG. 9 is an isometric diagram of an exemplary gun injection feed system, according to an embodiment of the present invention.

FIG. 9 illustrates an exemplary gun injection feed system, according to an embodiment of the present invention. The projectile 50 is injected into the spiral launch tube entrance 64 when the entrance to the tube is aligned with, and moving away from, the gun tube 34. Projectiles are transferred from the feed block 52 to the launch tube 24 when the feed block is gently touching the launch tube during the feed block travel to the right at the midpoint of the rails.

Another embodiment of the present invention includes a phase swing launch method in which a "soft elastic collision" occurs between a projectile 50 traveling in the spiral launch tube 24 and a track displacement wave traveling at high speed around the track. As such, the projectile 50 executes a swing in phase relative to the traveling wave as the projectile 50 accelerates and is thrown forward. The phase swing approach is used to reduce the size of both the ring and spiral mass launcher accelerators.

Figure 10:
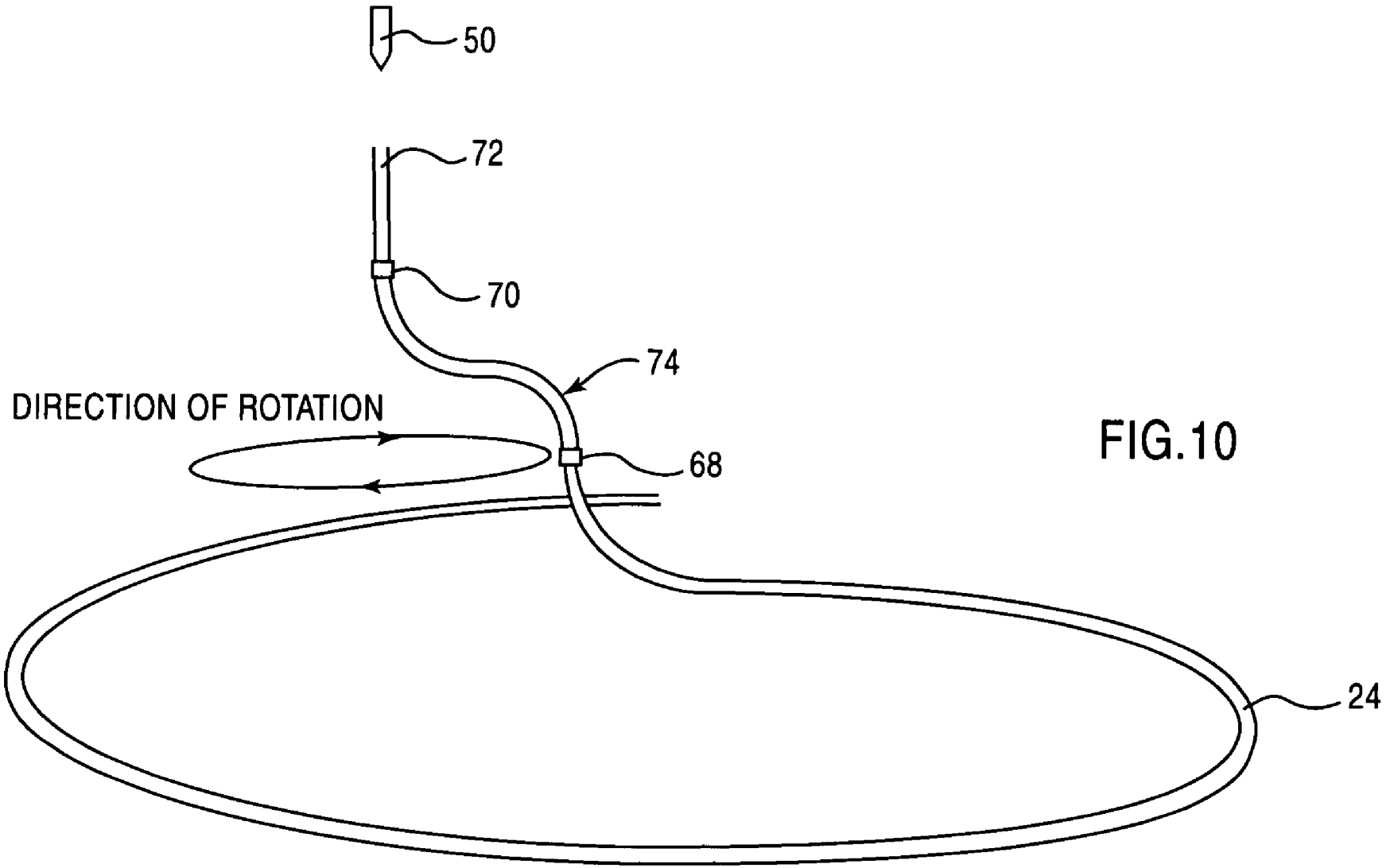
FIG. 10 is schematic diagram of an exemplary centrifugal feed system, according to an embodiment of the present invention.

FIG. 10 shows an exemplary centrifugal feed system, according to an embodiment of the present invention. In this system, a rotating feed tube 74 shaped like a "crank arm" extends perpendicular relative to the spiral plane of the launch tube 24. The lower pivot 68 swings around the gyration circle and the upper pivot 70 is stationary relative thereto. A projectile 50 is propelled into the stationary feed inlet 72 and is accelerated by centripetal force to swing speed v as it moves out through the tube between the pivots 68, 70. The projectile 50 then passes down into the spiral where the projectile is further accelerated. This has the advantage that the entrance tube 72 is stationary and connects continuously to the gyrating spiral launch tube 24, but the feed involves a small radius of curvature tube that limits the projectile length.

Further details and aspects of the present invention are described in the article included herein as Exhibit 1, entitled "Constant-Frequency Hypervelocity Slings." The article of Exhibit 1 provides further explanations of FIGS. 1, 6, 7, 9, and 10. The article also provides additional descriptions and figures of embodiments of the present invention and is incorporated by reference herein in their entirety.

In light of the above descriptions, a mass launcher according to the present invention can have one or more of the following characteristics: tube of constant wall thickness; rapid fire stream; hypervelocity; off-the-shelf components such as electric motors or turbines, and bearings; an inertial storage device in which projectiles passing through extract energy with no pulsed power train; and mechanical rolling and projectile sliding friction coefficients decrease with increasing size.

Further background for the present invention is provided by the publications and patents listed in Exhibit 1, which are incorporated by reference herein in their entirety.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

We claim:

1. An apparatus for moving a mass, comprising:

a spindle support assembly;

a first arm having a first end and a second end, the first end pivotally connected to the spindle support assembly, and the second end having a first cup;

a second arm having a first end and a second end, the first end pivotally connected to the spindle support assembly, and the second end having a second cup;

a shaft disposed within the first cup and the second cup, wherein the shaft has a radial opening; and an arcuate track that passes through the radial opening of the shaft.

2. The apparatus of claim 1, further comprising at least one bearing disposed inside at least one of the first cup and second cup, and around the shaft.

3. The apparatus of claim 2, wherein the bearing comprises a concentrically nested bearing.

4. The apparatus of claim 1, further comprising a plurality of stacked bearings disposed inside at least one of the first cup and second cup, and around the shaft.

5. The apparatus of claim 4, wherein the stacked bearings comprise concentrically nested bearings.

6. The apparatus of claim 1, wherein the first arm and the second arm comprise flat horizontal members.

7. The apparatus of claim 1, wherein the spindle support assembly, first and second arms, shaft, and bearing shaft are disposed within a housing.

8. The apparatus of claim 1, wherein the first end of the first arm and the first end of the second arm comprise a counterweight.

9. The apparatus of claim 1, wherein the arcuate track comprise a spiral track.

10. The apparatus of claim 1, wherein the arcuate track comprises a tube.

11. The apparatus of claim 10, wherein the tube comprises vent slots on an inner surface of the arcuate track.

* * * * *